US010756478B2

(12) United States Patent
Kutsuna et al.

(10) Patent No.: US 10,756,478 B2
(45) Date of Patent: Aug. 25, 2020

(54) TERMINAL AND METHOD OF CONNECTING ELECTRIC WIRE TO TERMINAL

(71) Applicant: Yazaki Corporation, Minato-ku, Tokyo (JP)

(72) Inventors: Youji Kutsuna, Makinohara (JP); Keiichiro Kurashige, Makinohara (JP)

(73) Assignee: Yazaki Corporation, Minato-ku, Tokyo (JP)

( * ) Notice: Subject to any disclaimer, the term of this patent is extended or adjusted under 35 U.S.C. 154(b) by 0 days.

(21) Appl. No.: 16/660,128

(22) Filed: Oct. 22, 2019

(65) Prior Publication Data

US 2020/0136305 A1 Apr. 30, 2020

(30) Foreign Application Priority Data

Oct. 24, 2018 (JP) ..... 2018-200356

(51) Int. Cl.
*H01R 13/58* (2006.01)
*H01R 13/42* (2006.01)

(52) U.S. Cl.
CPC ..... *H01R 13/5808* (2013.01); *H01R 13/42* (2013.01)

(58) Field of Classification Search
CPC ... H01R 13/5808; H01R 13/42; H01R 9/0518
USPC ..... 439/585
See application file for complete search history.

(56) References Cited

U.S. PATENT DOCUMENTS 6,099,352 A * 8/2000 Yamaguchi ..... H01R 13/6592 439/607.5
6,149,462 A * 11/2000 Sugie ..... H01R 13/4368 439/595
9,325,082 B2 * 4/2016 Furukawa ..... H01R 4/188
9,954,306 B2 * 4/2018 Taguchi ..... H01R 12/75
10,446,954 B2 * 10/2019 Sakai ..... H01R 11/12

FOREIGN PATENT DOCUMENTS

JP 2003-203743 A 7/2003

* cited by examiner

*Primary Examiner* — Hien D Vu
(74) *Attorney, Agent, or Firm* — Banner & Witcoff, Ltd.

(57) ABSTRACT

A terminal integrally includes a connecting portion connected to a mating terminal, a cover fixing portion that is positioned rearward of the connecting portion and fixes a cover of an electric wire including a conductor core wire and the cover covering the conductor core wire, and a conductor fixing portion that is positioned between the connecting portion and the cover fixing portion and fixes the conductor core wire exposed from the electric wire.

3 Claims, 23 Drawing Sheets

TERMINAL AND METHOD OF CONNECTING ELECTRIC WIRE TO TERMINAL

CROSS REFERENCE TO RELATED APPLICATIONS

This application claims priority from Japanese Patent Application No. 2018-200356 filed on Oct. 24, 2018, the entire contents of which are incorporated herein by reference.

BACKGROUND OF THE INVENTION

Field of the Invention

The present invention relates to a terminal and a method of connecting an electric wire to the terminal.

Description of Related Art

In related art, a connector including a housing having a terminal accommodating portion that accommodates a terminal connected to an electric wire is widely known (see, for example, Patent Literature 1: JP-A-2003-203743). In this type of connector, usually, the terminal connected to the electric wire is accommodated in a normal insertion position of the terminal accommodating portion by inserting the terminal into the terminal accommodating portion from the rear end of the housing while crimping the terminal to the electric wire and holding the electric wire to which the terminal is fixed.

[Patent Literature 1] JP-A-2003-203743

In recent years, in response to a demand for miniaturization of connectors, terminals have been miniaturized, and electric wires have also been reduced in diameter. When the electric wire to which the terminal is fixed is held and the terminal is inserted from the rear end of the housing when the electric wire is thin, the electric wire is likely to be bent due to the mass of the terminal acting on the electric wire and the long distance from the holding position of the electric wire to the front end of the terminal. When the electric wire is bent, it is difficult to aim at the opening of the terminal accommodating portion at the rear end of the housing and insert the terminal into the opening.

On the other hand, this problem can be easily solved by adopting the assembly procedure of connecting the electric wire to the terminal after accommodating only the terminal in the terminal accommodating portion of the housing. From the above, it is desirable to develop a terminal that can be easily connected to an electric wire after only the terminal is accommodated in the terminal accommodating portion of the housing.

SUMMARY

One or more embodiments provide a terminal that can be easily connected to an electric wire after only the terminal is accommodated in a terminal accommodating portion of a housing, and a method of connecting the electric wire to the terminal.

In an aspect (1), one or more embodiments provide a terminal integrally including a connecting portion connected to a mating terminal, a cover fixing portion that is positioned rearward of the connecting portion and fixes a cover of an electric wire including a conductor core wire and the cover covering the conductor core wire, and a conductor fixing portion that is positioned between the connecting portion and the cover fixing portion and fixes the conductor core wire exposed from the cover of the electric wire. The terminal is connected to a front end of the electric wire. The terminal is made of a plate member and extends in a front-rear direction. The conductor fixing portion includes an inclined portion extending obliquely to one side from the front-rear direction and having a through hole passing through in a thickness direction. The conductor fixing portion is configured to fix the conductor core wire by pressing a predetermined portion of the conductor fixing portion into the other side opposite to the one side in a state that the conductor core wire is inserted into the through hole so that an end edge of the through hole bites the conductor core wire.

In an aspect (2), the conductor fixing portion may integrally include a first inclined portion, a second inclined portion, and a coupling portion. The first inclined portion is connected to a rear end portion of the connecting portion, extends obliquely to the one side and a rear side from the rear end portion of the connecting portion, and includes a first through hole passing through in the thickness direction. The second inclined portion is connected to a front end portion of the cover fixing portion, extends obliquely to the one side and a front side from a front end portion of the cover fixing portion, and includes a second through hole passing through in the thickness direction. The coupling portion connects extended end portions of the first inclined portion and the second inclined portion to each other. The conductor fixing portion is configured to fix the conductor core wire by pressing the coupling portion to the other side in a state that the conductor core wire of the electric wire is inserted into the first and second through holes so that the end edges of the first and second through holes bite the conductor core wire.

In an aspect (3), a method of connecting the electric wire to the terminal according to the aspect (1) or (2), may include accommodating the terminal in a terminal accommodating portion of a housing, inserting the conductor core wire exposed from the cover of the electric wire into the through hole of the terminal accommodated in the terminal accommodating portion, and pressing the predetermined portion of the conductor fixing portion to the other side in a state that the conductor core wire is inserted into the through hole and making the end edge of the through hole to bite the conductor core wire so as to fix the conductor core wire to the conductor fixing portion.

According to the aspect (1), the conductor core wire of the electric wire can be fixed to the terminal only by pressing a predetermined portion of the conductor fixing portion to the other side to plastically deform the conductor fixing portion in a state that the conductor core wire is inserted into the through hole when the electric wire is connected to the terminal after the terminal is accommodated in the terminal accommodating portion of the housing. Therefore, even after only the terminal is accommodated in the terminal accommodating portion of the housing, the electric wire can be extremely easily connected to the terminal.

According to the aspect (2), since the end edges of the first and second through holes can be bitten into the conductor core wire, the conductor core wire of the electric wire can be more firmly fixed to the terminal as compared with the mode in which the end edge of one through hole is bitten into the conductor core wire.

According to the aspect (3), the conductor core wire of the electric wire can be fixed to the terminal only by pressing a predetermined portion of the conductor fixing portion to the other side to plastically deform the conductor fixing portion in a state that the conductor core wire is inserted into the through hole when the electric wire is connected to the terminal after the terminal is accommodated in the terminal accommodating portion of the housing. Therefore, even after only the terminal is accommodated in the terminal accommodating portion of the housing, the electric wire can be extremely easily connected to the terminal.

According to one or more embodiments, it is possible to provide a terminal that can be easily connected to the electric wire after only the terminal is accommodated in the terminal accommodating portion of the housing, and a method of connecting the electric wire to the terminal.

The present invention has been briefly described above. Details of the present invention will be further clarified by reading through modes for carrying out the invention described below with reference to the accompanying drawings.

DETAILED DESCRIPTION

Embodiment

Figure 1:
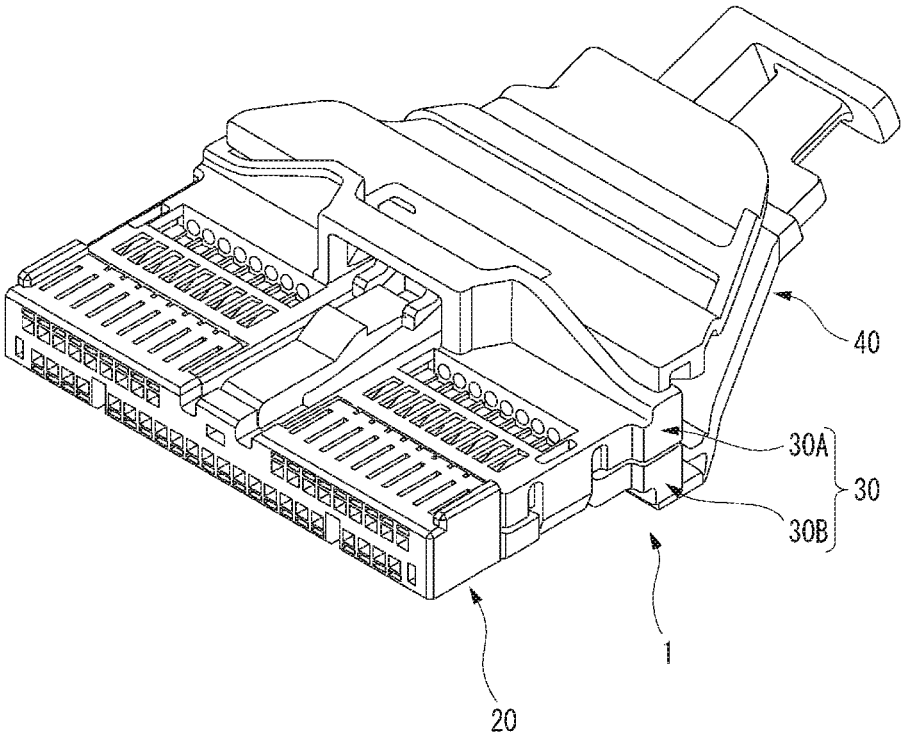
FIG. 1 is a perspective view of a connector including a terminal according to the present embodiment.

Hereinafter, a connector 1 including terminals 10 according to an embodiment of the present invention will be described with reference to the drawings. Hereinafter, for convenience of description, in the axial direction (fitting direction) of the connector 1, a side on which a mating terminal (not shown) is fitted (left side in FIG. 1) is referred to as a front side, and an opposite side thereof (right side in FIG. 1) is referred to as a rear side. An upper side and a lower side in FIG. 1 are referred to as an upper side and a lower side, respectively.

Figure 2:
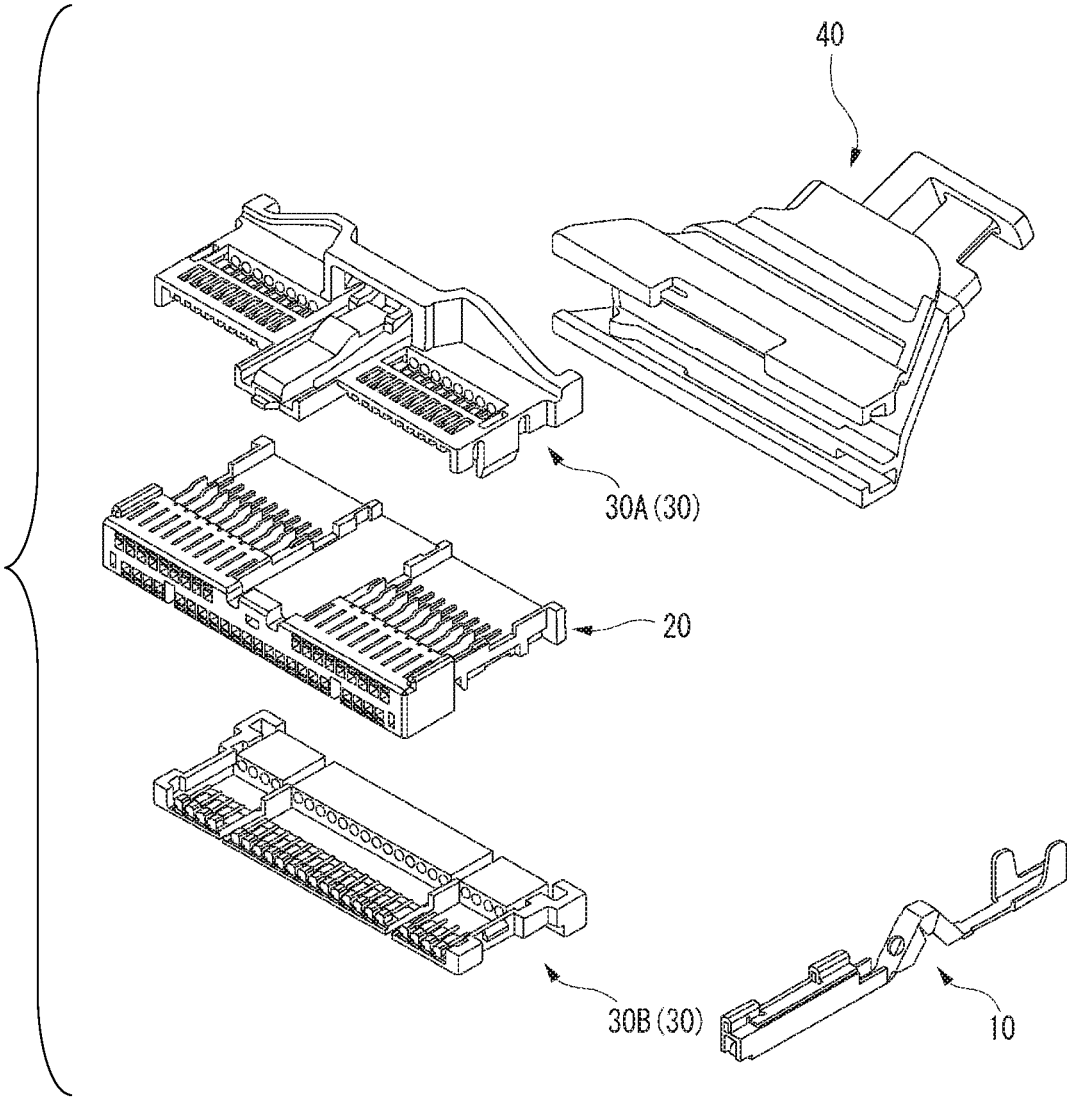
FIG. 2 is an exploded perspective view of the connector shown in FIG. 1.

As shown in FIG. 2, the connector 1 includes the terminals 10, a housing 20, a cover 30, and a connector cover 40. Hereinafter, each component constituting the connector 1 will be described in order.

Figure 3:
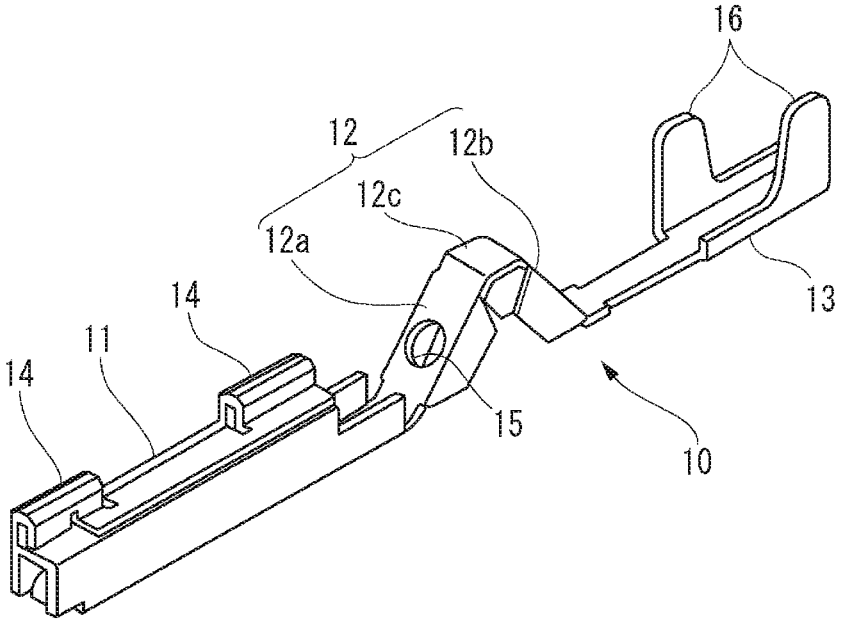
FIG. 3 is a perspective view of the terminal shown in FIG. 2.
Figure 4:
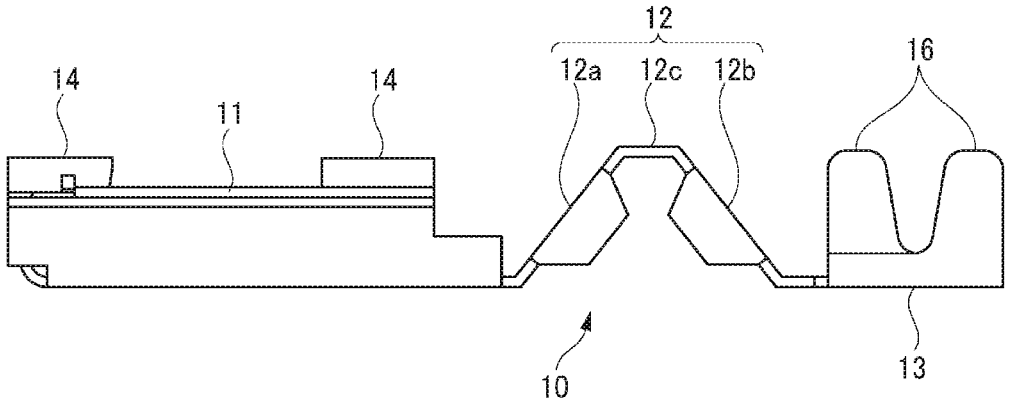
FIG. 4 is a side view of the terminal.
Figure 5:
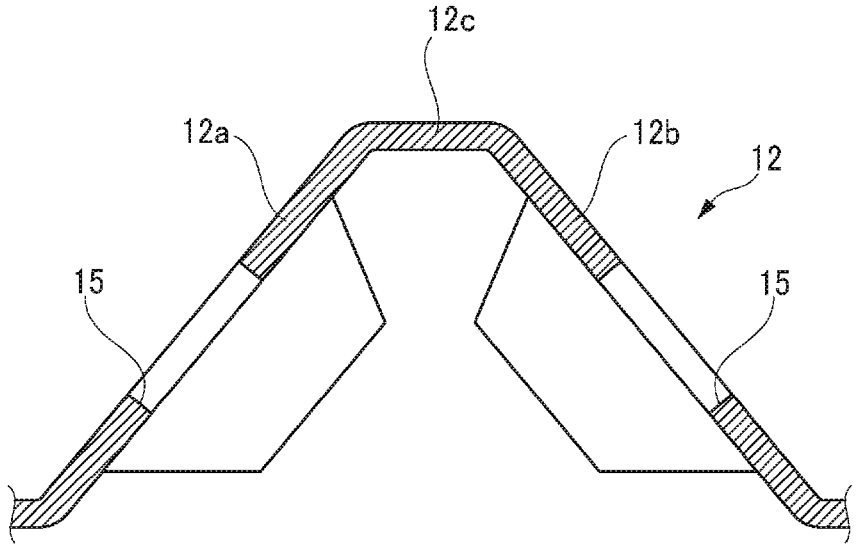
FIG. 5 is a main cross-sectional view of a conductor fixing portion of the terminal.

First, the terminals 10 will be described with reference to FIGS. 3 to 5. The terminal 10 is a female terminal formed by pressing, bending, or the like on a plate-like metal member, and includes a connecting portion 11 to which a mating terminal (male terminal, not shown) is fitted, a conductor fixing portion 12 for fixing a conductor core wire W1 of the electric wire W (see FIG. 29) to the rear side of the connecting portion 11, and a cover fixing portion 13 which is continuous with the rear side of the conductor fixing portion 12 and fixes a covering W2 of the electric wire W.

The connecting portion 11 has a rectangular tubular shape, and a pair of protruding portions 14 protruding upward are formed in both end portions in the front-rear direction on one side in the width direction of the upper surface of the connecting portion 11. In particular, the protruding portion 14 on the front side of the pair of protruding portions 14 is engaged with a lance 26 (see FIG. 8) of the housing 20, and performs a retaining function of the terminal 10, as will be described later.

The conductor fixing portion 12 includes a first inclined portion 12*a*, a second inclined portion 12*b*, and a coupling portion 12*c*. The first inclined portion 12*a* is continuous to the rear end portion of the connecting portion 11, extends obliquely rearward and upward from the rear end portion of the connecting portion 11, and includes a through hole 15 passing therethrough in the thickness direction. The second inclined portion 12*b* is continuous to the front end portion of the cover fixing portion 13, extends obliquely forward and upward from the front end portion of the cover fixing portion 13, and includes a through hole 15 passing therethrough in the thickness direction. The coupling portion 12*c* couples extended end portions of the first inclined portion 12*a* and the second inclined portion 12*b* and extends in the front-rear direction. A method of fixing the conductor core wire W1 of the wire W by the conductor fixing portion 12 will be described in detail later.

A pair of crimping pieces 16 are formed in the cover fixing portion 13. The electric wire W is fixed to the cover fixing portion 13 by crimping the cover W2 of the electric wire W by the crimping pieces 16.

Figure 6:
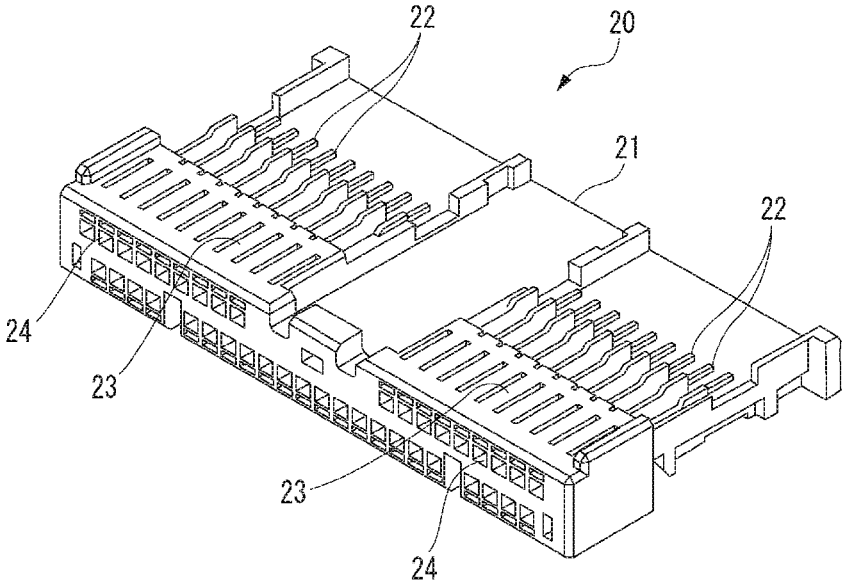
FIG. 6 is a perspective view of a housing shown in FIG. 2.
Figure 7:
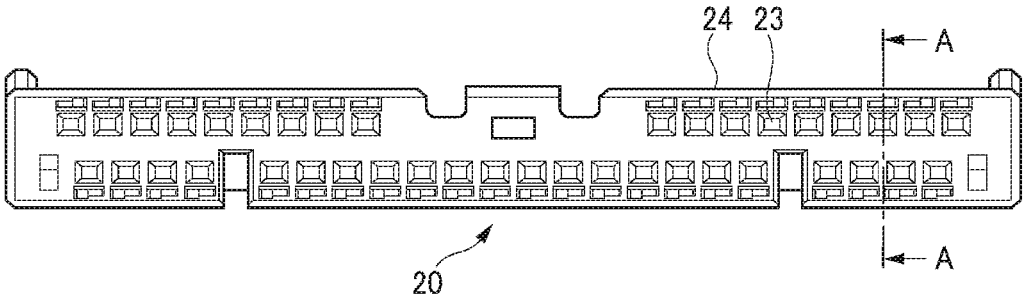
FIG. 7 is a front view of the housing.

Next, the housing 20 will be described with reference to FIGS. 6 to 12. In particular, as shown in FIGS. 6 and 9, the housing 20 includes a housing main body 21 having a rectangular flat plate shape. In each of upper and lower surfaces of the housing main body 21, a plurality of terminal accommodating portions for accommodating a plurality of the terminals 10 are formed. The configurations of the upper surface side and the lower surface side of the housing main body 21 are slightly different from each other, but are substantially the same, and only the configuration of the upper surface side of the housing main body 21 will be described below.

A plurality of standing walls 22 extending in the front-rear direction at intervals in the width direction are integrally formed on the upper surface of the housing main body 21. Each standing wall 22 performs a function of partitioning two terminal accommodating portions adjacent in the width direction. That is, a plurality of the terminal accommodating portions partitioned by a plurality of the standing walls 22 are formed on the upper surface of the housing main body 21 so as to be aligned in the width direction.

Top wall portions 23 are formed integrally on the front side portion of the housing main body 21 so as to close the upper sides of the terminal accommodating portions. That is, a front side portion of a terminal accommodating portion has a tubular shape whose upper side is closed by one of the top wall portions 23, and an upper portion of a rear side portion of the terminal accommodating portion is opened. An opening 24 is formed at the front side end of each terminal accommodating portion (see FIGS. 6 to 8). The mating terminal (male terminal) is inserted into the terminal accommodating portion of the housing main body 21 through the opening 24.

Figure 8:
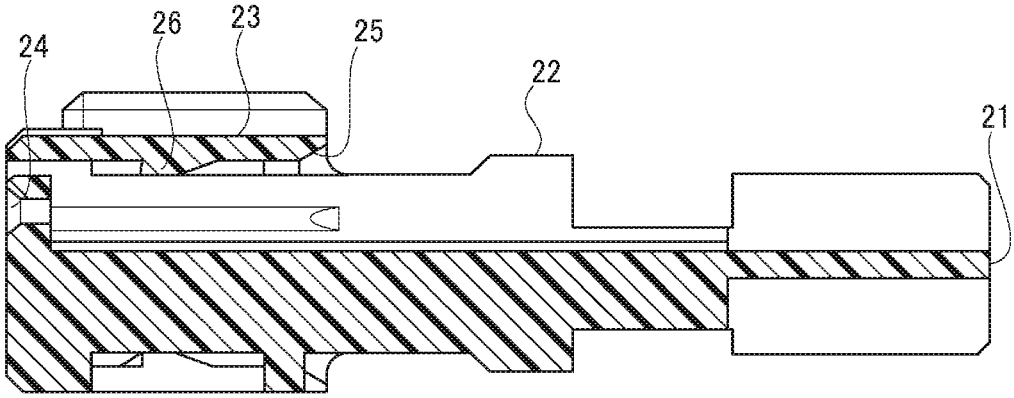
FIG. 8 is a cross-sectional view taken along line A-A in FIG. 7.
Figure 9:
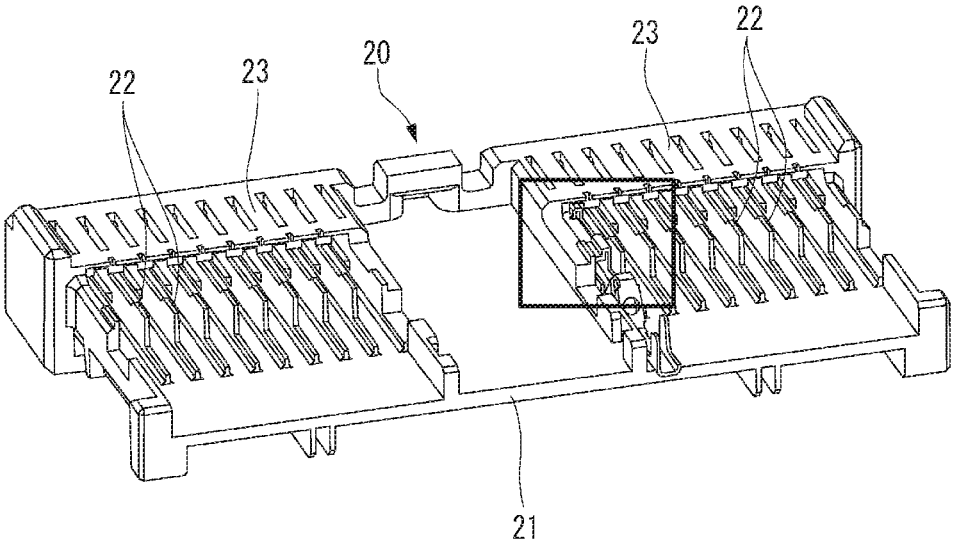
FIG. 9 is a perspective view of the housing as viewed from the rear side.

As shown in FIG. 8, tapered surfaces 25 inclined rearward and upward are formed at the rear end edges of the top wall portions 23. As will be described later, the tapered surfaces 25 are used when an upper cover 30A is assembled to the housing 20 (see FIG. 21). A lance 26 protruding downward into each terminal accommodating portion is integrally formed on the lower surface of the central portion in the front-rear direction of the top wall portion 23.

Figure 10:
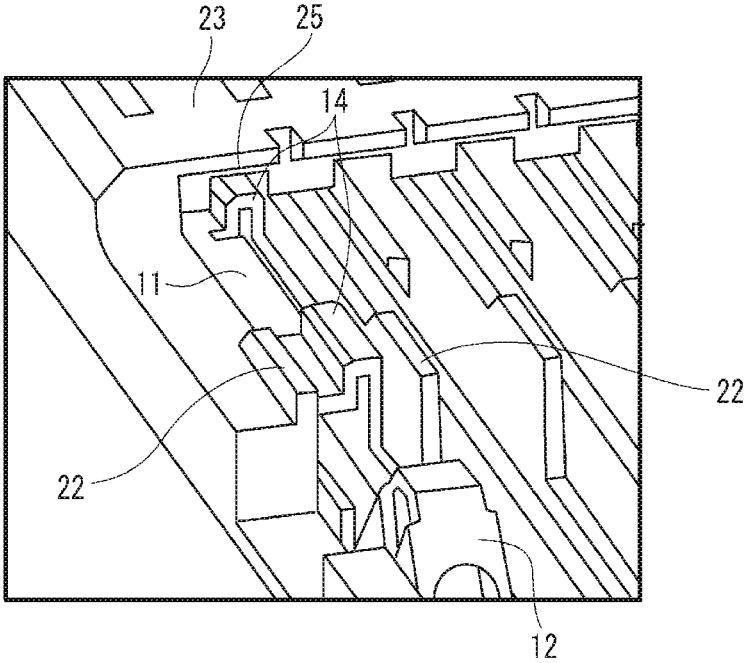
FIG. 10 is an enlarged view of the frame in FIG. 9.

As described above, in the housing main body 21, the upper side of the rear side portion of each terminal accommodating portion is opened. Therefore, the terminal 10 is placed in the rear side portion of the terminal accommodating portion as shown in FIGS. 9 and 10 while holding the terminal 10, so that the terminal 10 can be easily inserted into the primary locking position (intermediate insertion position) in the vicinity of the normal insertion position in the front side portion (tubular portion) of the terminal accommodating portion (see FIGS. 11 and 12).

Figure 11:
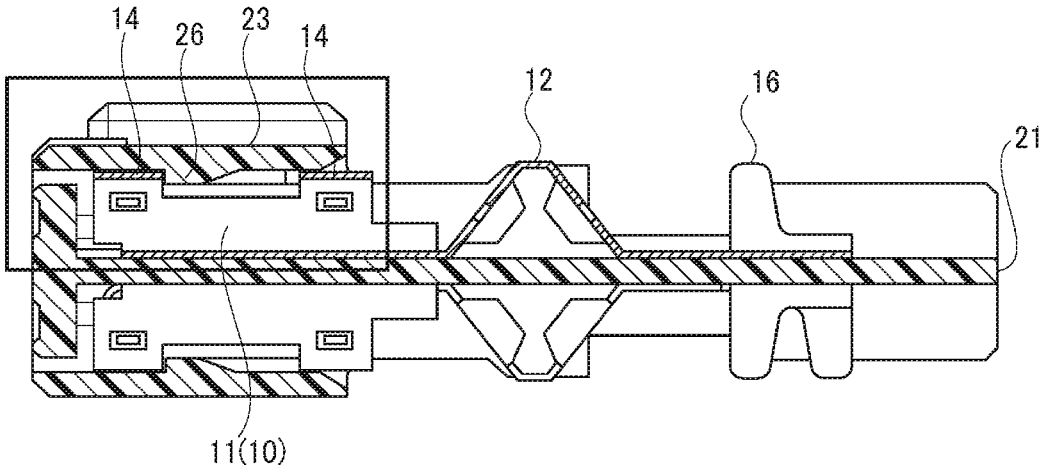
FIG. 11 is a cross-sectional view corresponding to FIG. 8 in the housing in which the terminal is in a primary locking position.
Figure 12:
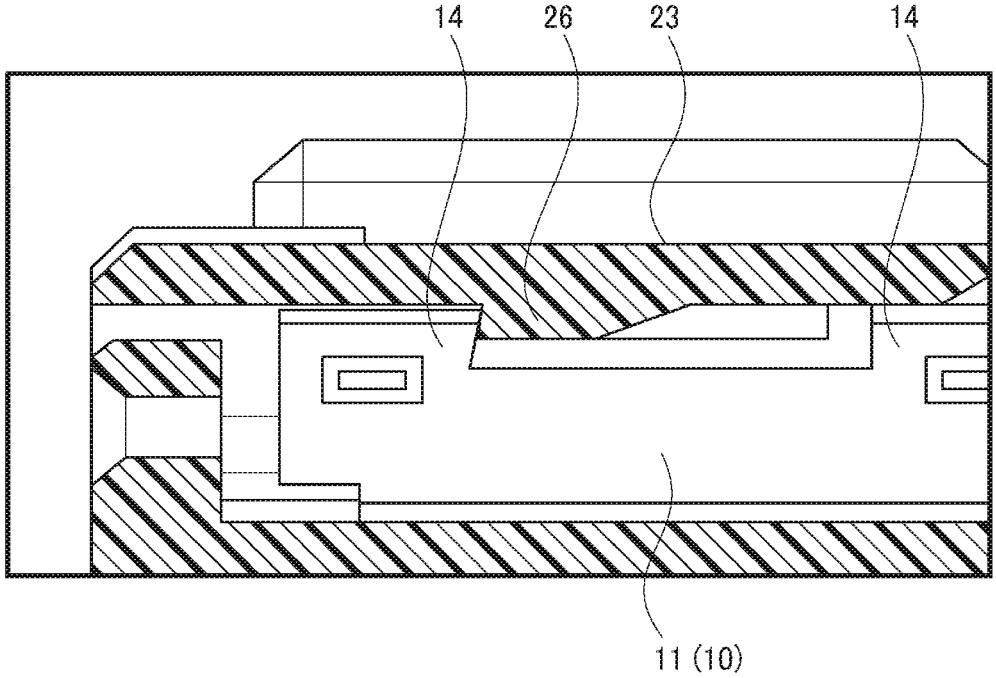
FIG. 12 is an enlarged view of the frame in FIG. 11.

In the process in which the terminal 10 is inserted to the primary locking position shown in FIGS. 11 and 12, the lance 26 is brought into contact with the protruding portion 14 on the front side of the terminal 10 to ride on the protruding portion 14 while elastically deforming, and then elastically returns to the initial position when the protruding portion 14 passes by. As a result, as shown in FIG. 12, the protruding portion 14 is engaged with the lance 26, so that terminal 10 is retained in the housing 20.

Next, the cover 30 will be described with reference to FIGS. 13 to 22. In this example, an upper cover 30A and a lower cover 30 B are used as the cover 30 (see FIG. 2). The upper cover 30A is assembled to the upper surface side of the housing main body 21 to close the upper sides of the rear side portions of the terminal accommodating portions on the upper surface side, and the lower cover 30B is assembled to the lower surface side of the housing main body 21 to close the lower sides of the rear side portions of the terminal accommodating portions on the lower surface side.

Figure 13:
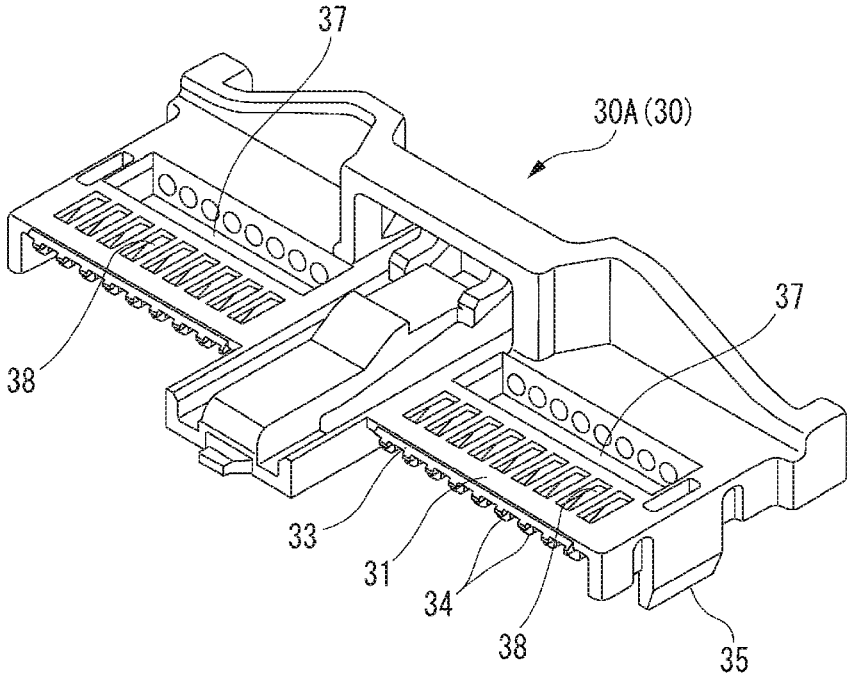
FIG. 13 is a perspective view of an upper cover shown in FIG. 2.
Figure 14:
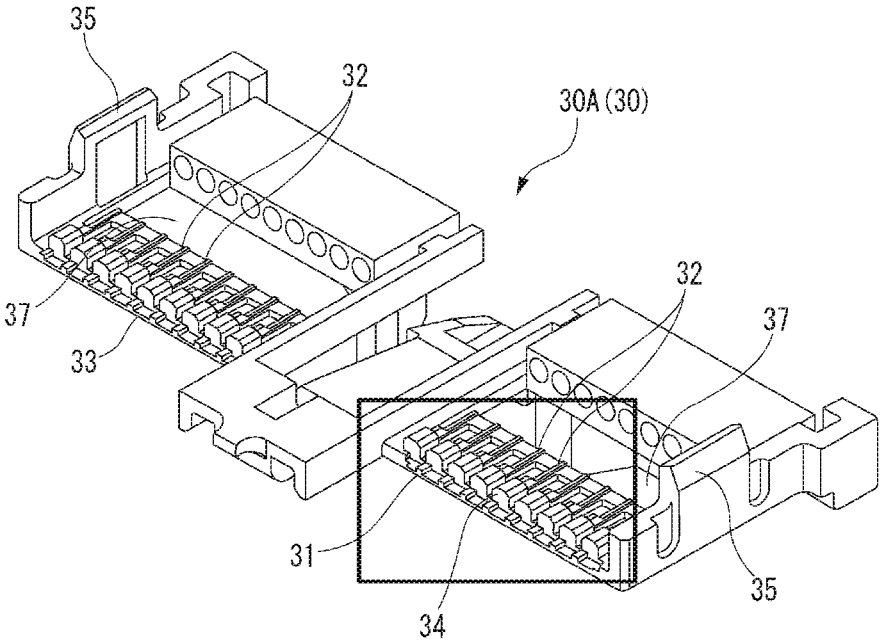
FIG. 14 is a perspective view of the reversed upper cover.

First, the upper cover 30A will be described with reference to FIGS. 13 to 15. FIG. 13 shows the upper cover 30A in the direction of assembly to the housing main body 21, and FIG. 14 shows the reversed upper cover 30A.

The upper cover 30A includes a substantially flat plate-shaped cover main body 31. A plurality of standing walls 32 extending in the front-rear direction at intervals in the width direction are integrally formed on the lower surface of the front side portion of the cover main body 31 so as to correspond to the standing walls 22 of the housing main body 21. Thus, in the assembled state of the upper cover 30A to the housing 20, the upper cover 30A closes the upper sides of the rear side portions of the terminal accommodating portions of the housing main body 21, and a terminal accommodating portion having a tubular shape continuing in the front-rear direction is formed in the front side portion and the rear side portion of the terminal accommodating portions.

A front end edge of the cover main body 31 of the upper cover 30A is formed with a tapered surface 33 inclined forward and downward. As will be described later, the tapered surface 33 is used when the upper cover 30A is assembled to the housing 20 (see FIG. 21).

Figure 15:
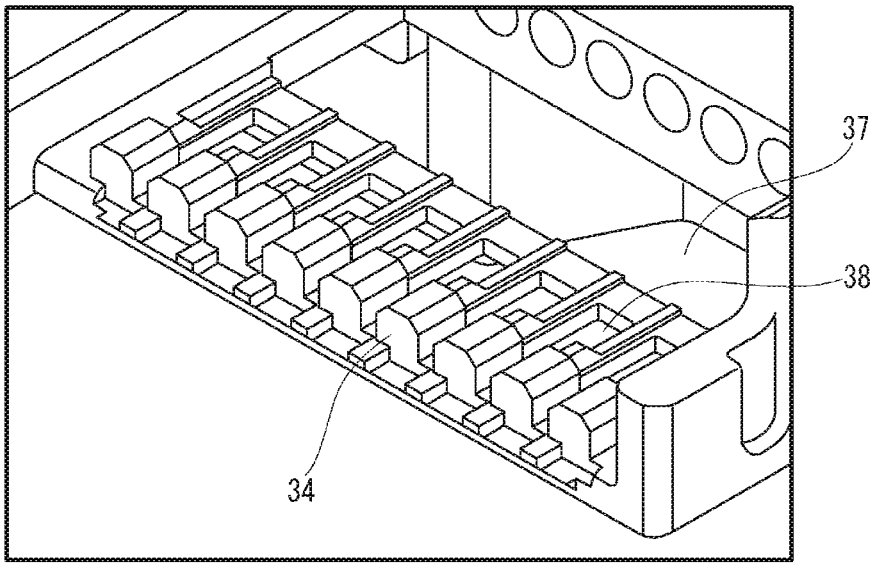
FIG. 15 is an enlarged view of the frame in FIG. 14.

As shown in FIG. 15, on the lower surface of the front end portion of the cover main body 31 of the upper cover 30A, a plurality of projection portions 34 projecting downward are integrally formed at positions of a plurality of the terminal accommodating portions (positions between adjacent standing walls 32) in the width direction. As will be described later, when the upper cover 30A is assembled to the housing 20, the projection portions 34 press the terminal 10 at the primary locking position forward to move the terminal 10 to the normal insertion position.

At both end portions in the width direction of the cover main body 31 of the upper cover 30A, engaging portions 35 which are engaged with engaging portions 36 (see FIGS. 16 and 17) of the lower cover 30B when the upper cover 30A is assembled to the housing 20 are integrally formed.

In the central portion in the front-rear direction of the cover main body 31 of the upper cover 30A, first through holes 37 are formed across a plurality of the terminal accommodating portions in the width direction. Further, in the front side portion (portion at the rear sides of the projection portions 34) of the cover main body 31 of the upper cover 30A, a second through hole 38 extending in the front-rear direction is formed at a position of each of a plurality of the terminal accommodating portions (position between adjacent standing walls 32) in the width direction. As will be described later, the first through hole 37 is used for inserting a jig 60 (see FIG. 34) for pressing the pair of crimping pieces 16 of the terminal 10, and the second through hole 38 is used for inserting a jig 50 (see FIGS. 30 and 32) for pressing the conductor fixing portion 12 of the terminal 10.

Figure 16:
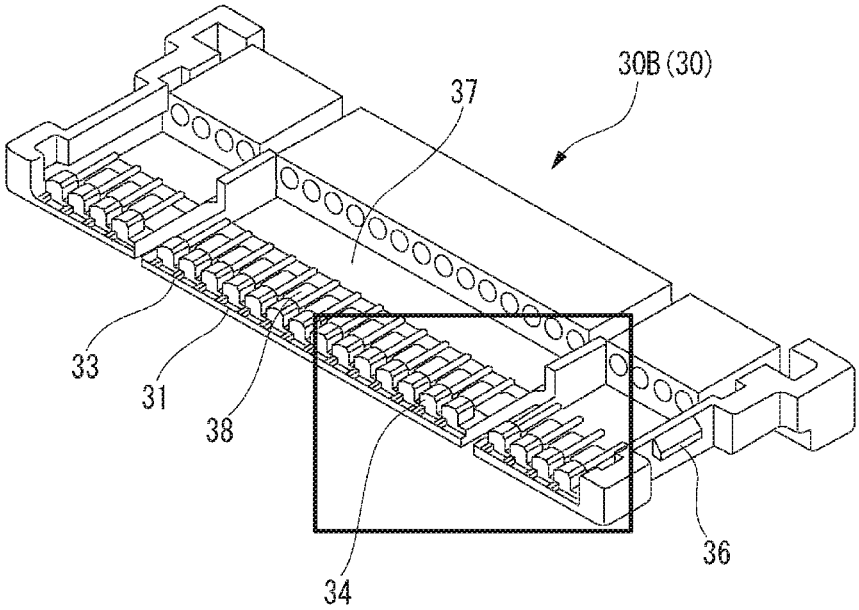
FIG. 16 is a perspective view of a lower cover shown in FIG. 2.
Figure 17:
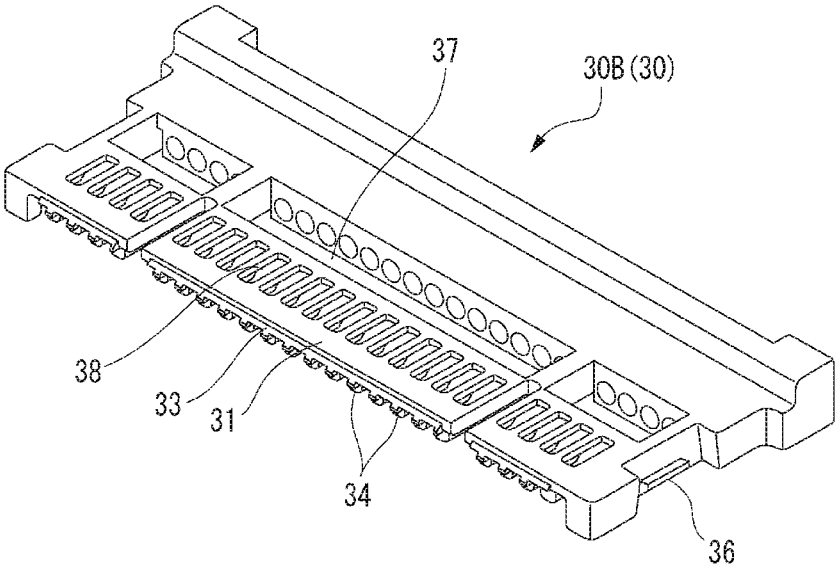
FIG. 17 is a perspective view of the reversed lower cover.
Figure 18:
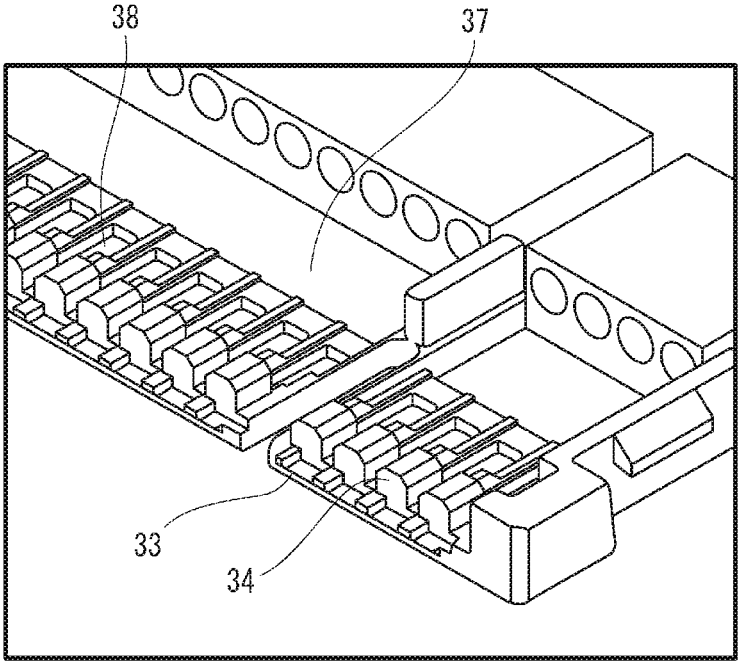
FIG. 18 is an enlarged view of the frame in FIG. 16.
Figure 19:
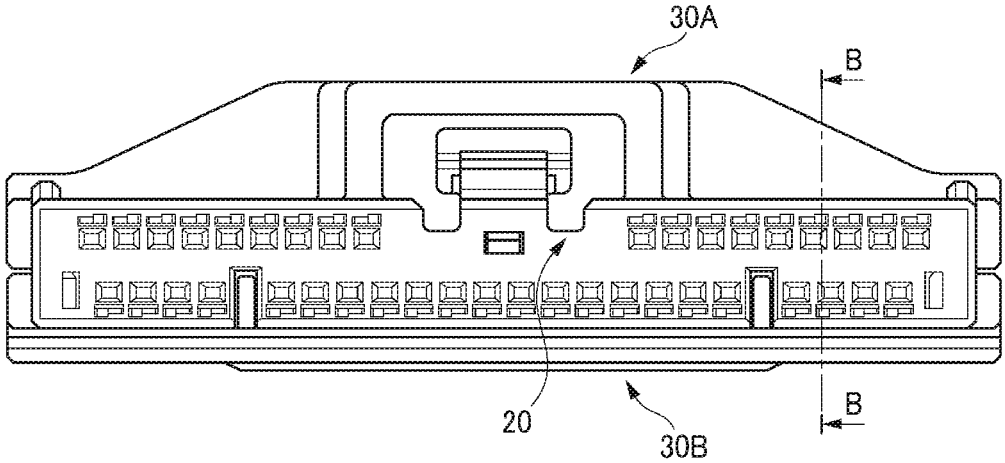
FIG. 19 is a front view of the connector shown in FIG. 1.

Next, the lower cover 30B will be described with reference to FIGS. 16 to 18. FIG. 16 shows the lower cover 30B in the direction of assembly to the housing main body 21, and FIG. 17 shows the reversed lower cover 30 B. The configurations of the upper cover 30A and the lower cover 30B are slightly different from each other, but are substantially the same except that the upper cover 30A and the lower cover 30B are symmetrical in the vertical direction. Therefore, the lower cover 30B is given the same reference numeral as the upper cover 30A with respect to the configuration corresponding to each configuration of the upper cover 30A, and the description thereof will be omitted.

Figure 20:
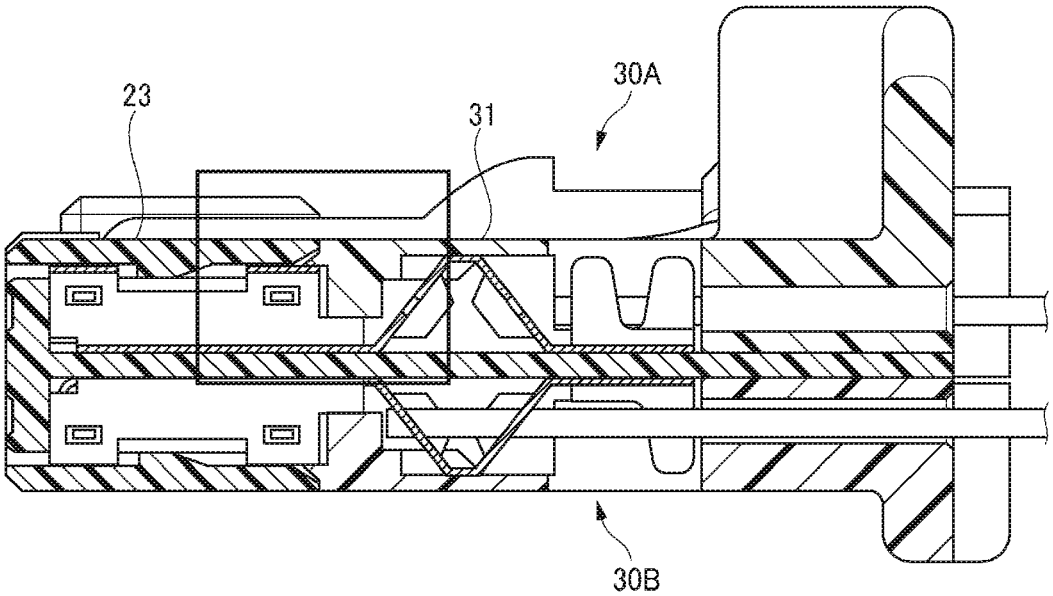
FIG. 20 is a sectional view taken along line B-B in FIG. 19.
Figure 21:
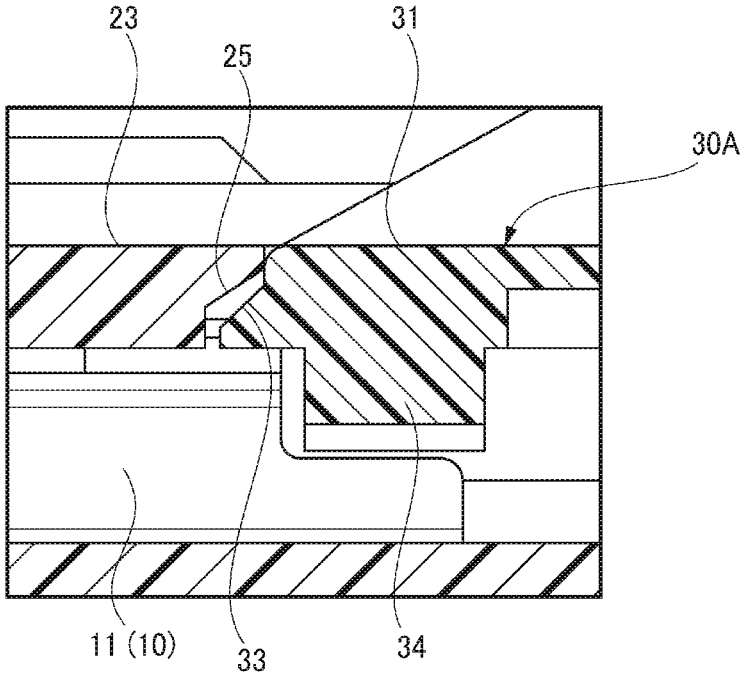
FIG. 21 is an enlarged view of the frame in FIG. 20.
Figure 22:
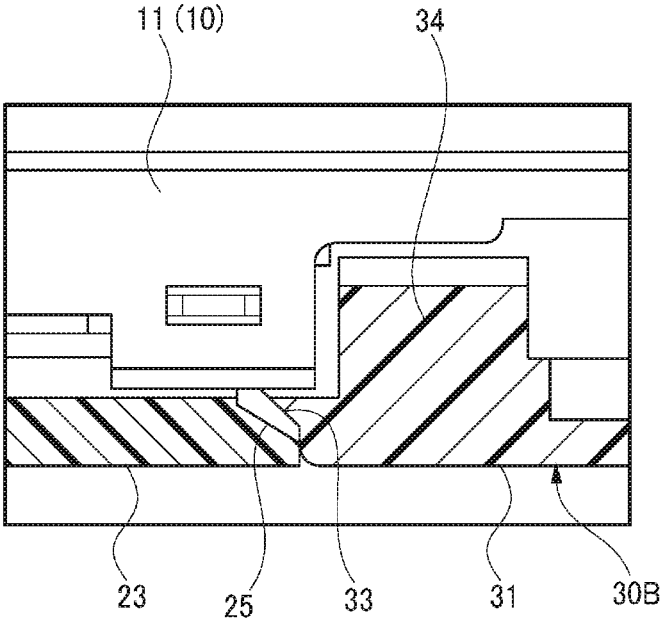
FIG. 22 is a view corresponding to FIG. 21 on the lower cover side.

As shown in FIGS. 19 to 22, in a state where the upper cover 30A and the lower cover 30B are assembled to the housing 20, the front end edge of the upper cover 30A and the rear end edges of the top wall portions 23 of the upper side of the housing are locked with the tapered surface 33 of the front end edge of the upper cover 30A entering the lower sides of the tapered surfaces 25 of the rear end edges of the top wall portions 23 of the upper surface side of the housing 20 (see FIG. 21). With the tapered surface 33 of the front end edge of the lower cover 30B entering the upper sides of the tapered surfaces 25 of the rear end edges of the top wall portions 23 on the lower surface side of the housing 20, the front end edge of the lower cover 30B and the rear edges of the top wall portions 23 on the lower surface side of the housing 20 are locked (see FIG. 22). Further, a plurality of the engaging portions 35 of the upper cover 30A and a plurality of the engaging portions 36 of the lower cover 30B are locked to each other. By the cooperation, each of the upper cover 30A and the lower cover 30B is assembled so as not to be relatively movable with respect to the housing 20, and the upper cover 30A and the lower cover 30B are assembled so as not to move relative to each other.

Figure 23:
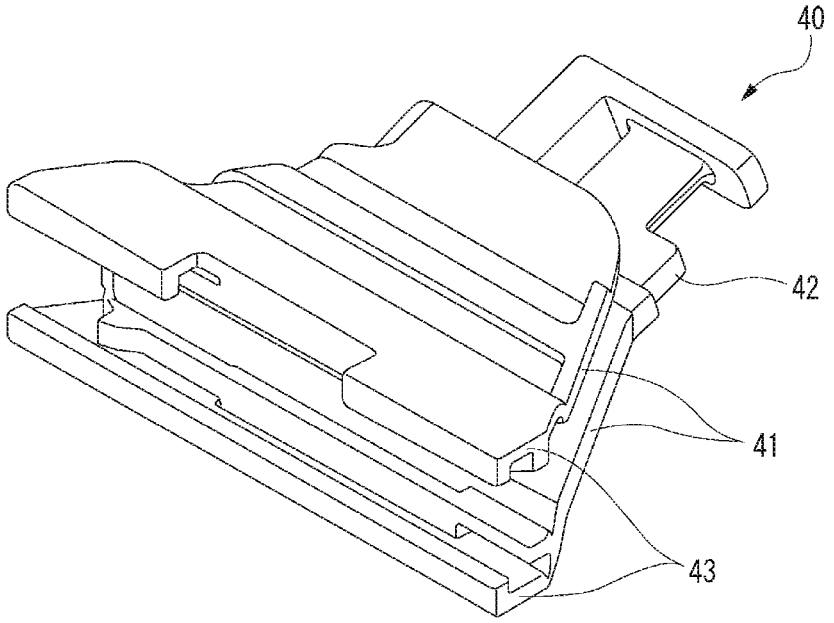
FIG. 23 is a perspective view of the connector cover shown in FIG. 2.

Next, the connector cover 40 will be described with reference to FIG. 23. The connector cover 40 includes a pair of plate-shaped electric wire accommodating portions 41 disposed to face each other in the upper-lower direction and an electric wire holding portion 42 integrally formed on the rear side of the lower electric wire accommodating portion 41. The connector cover 40 is fixed to the housing 20 (see FIG. 36) such that an engaging portion 43 provided on the front side of each of the pair of electric wire accommodating portions 41 projects to the rear side from the rear end surface of the housing 20 by attaching to an engaging portion (not shown) provided on the rear end portion of each of the upper cover 30A and the lower cover 30B in a state of being assembled to the housing 20.

The pair of electric wire accommodating portions 41 has a function of accommodating and protecting a plurality of the electric wires W extending rearward from a plurality of the terminals 10 accommodated in a plurality of the terminal accommodating portions. The electric wire holding portion 42 is a portion used to bundle and hold a plurality of the electric wires W extending rearward from the housing 20. A plurality of the electric wires W extending rearward from the housing 20 are held by the electric wire holding portion 42 in a bundled state using a tie band or the like.

Figure 24:
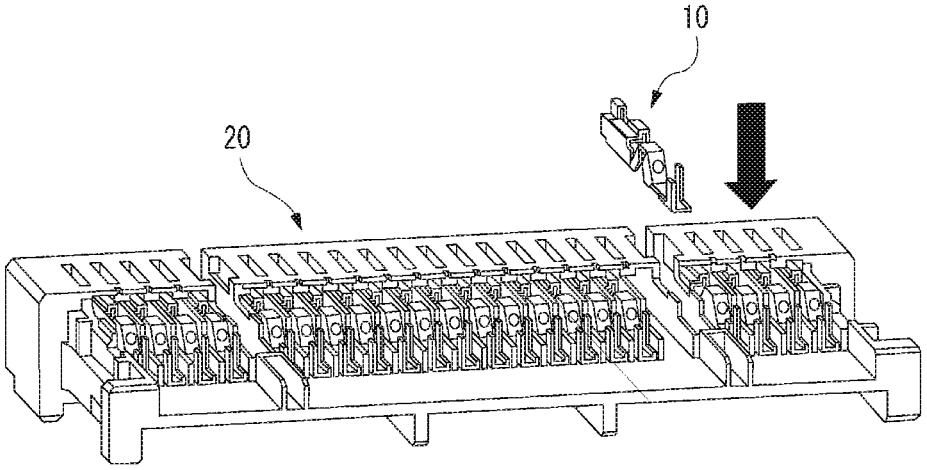
FIG. 24 is a first view for explaining a procedure of assembling the connector.

Next, an assembling procedure of the connector 1 will be described with reference to FIGS. 24 to 36. First, as shown in FIG. 24, each terminal 10 is disposed on the rear side portion with the open upper side of the predetermined terminal accommodating portion on the upper surface side (lower surface side in the normal orientation) of the housing 20 in the everted state by using a predetermined device, and the predetermined portion (typically, the rear end surface of the rectangular tubular connecting portion 11) of the terminal 10 is pushed forward to the primary locking position shown in FIGS. 11 and 12. As a result, the protruding portions 14 of the terminals 10 are engaged with the lances 26 of the housing 20, so that the terminals 10 inserted into the terminal accommodating portions can be retained in the housing 20.

Figure 25:
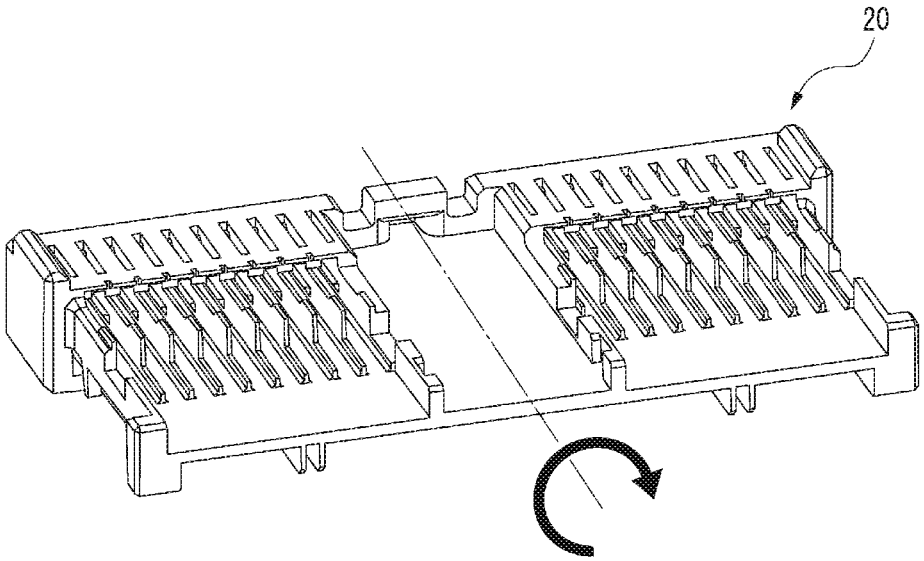
FIG. 25 is a second view for explaining the procedure of assembling the connector.
Figure 26:
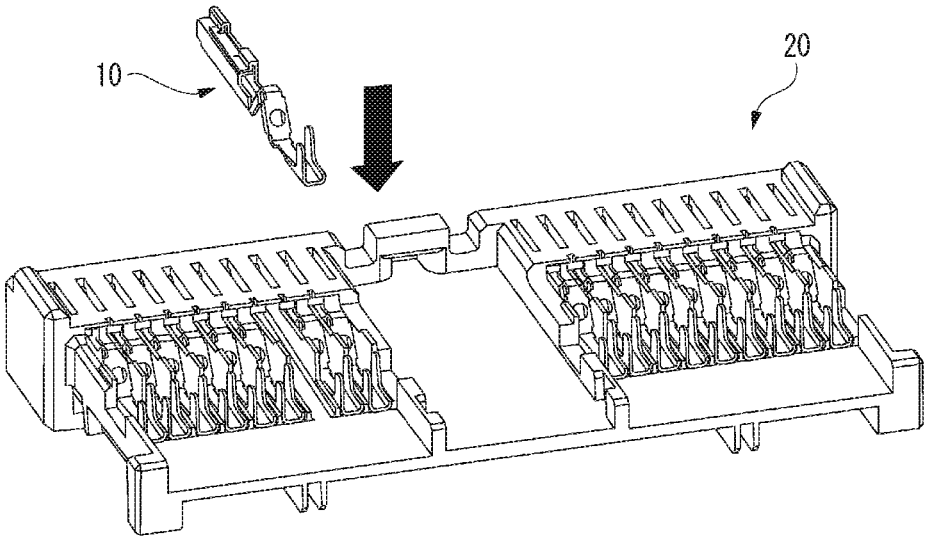
FIG. 26 is a third view for explaining the procedure of assembling the connector.

Next, as shown in FIG. 25, the housing 20 is reversed. As a result, the orientation of the housing 20 is the normal. In this state, similarly to the procedure shown in FIG. 24, the terminals are respectively inserted into the predetermined terminal accommodating portions on the upper surface side of the housing 20 to the primary locking positions, as shown in FIG. 26.

Figure 27:
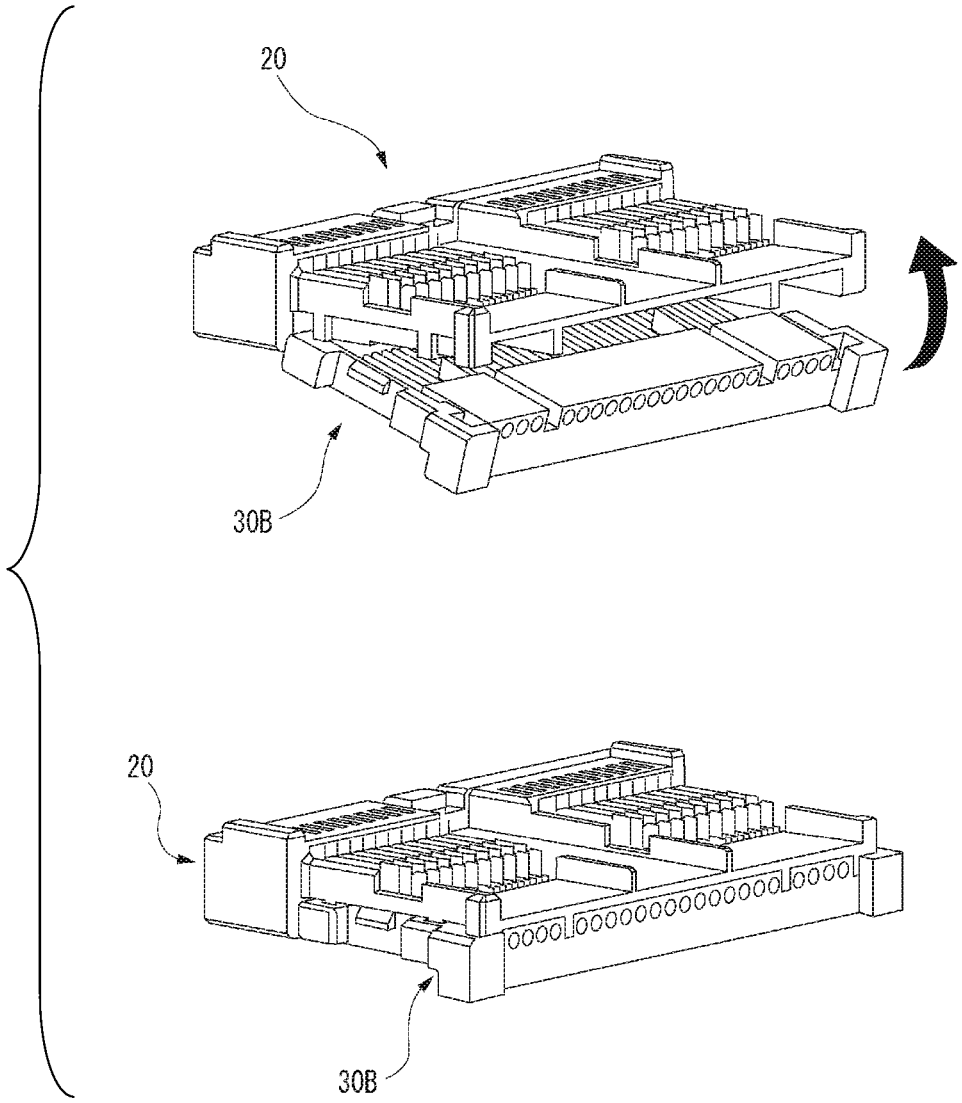
FIG. 27 is a fourth view for explaining the procedure of assembling the connector.
Figure 28:
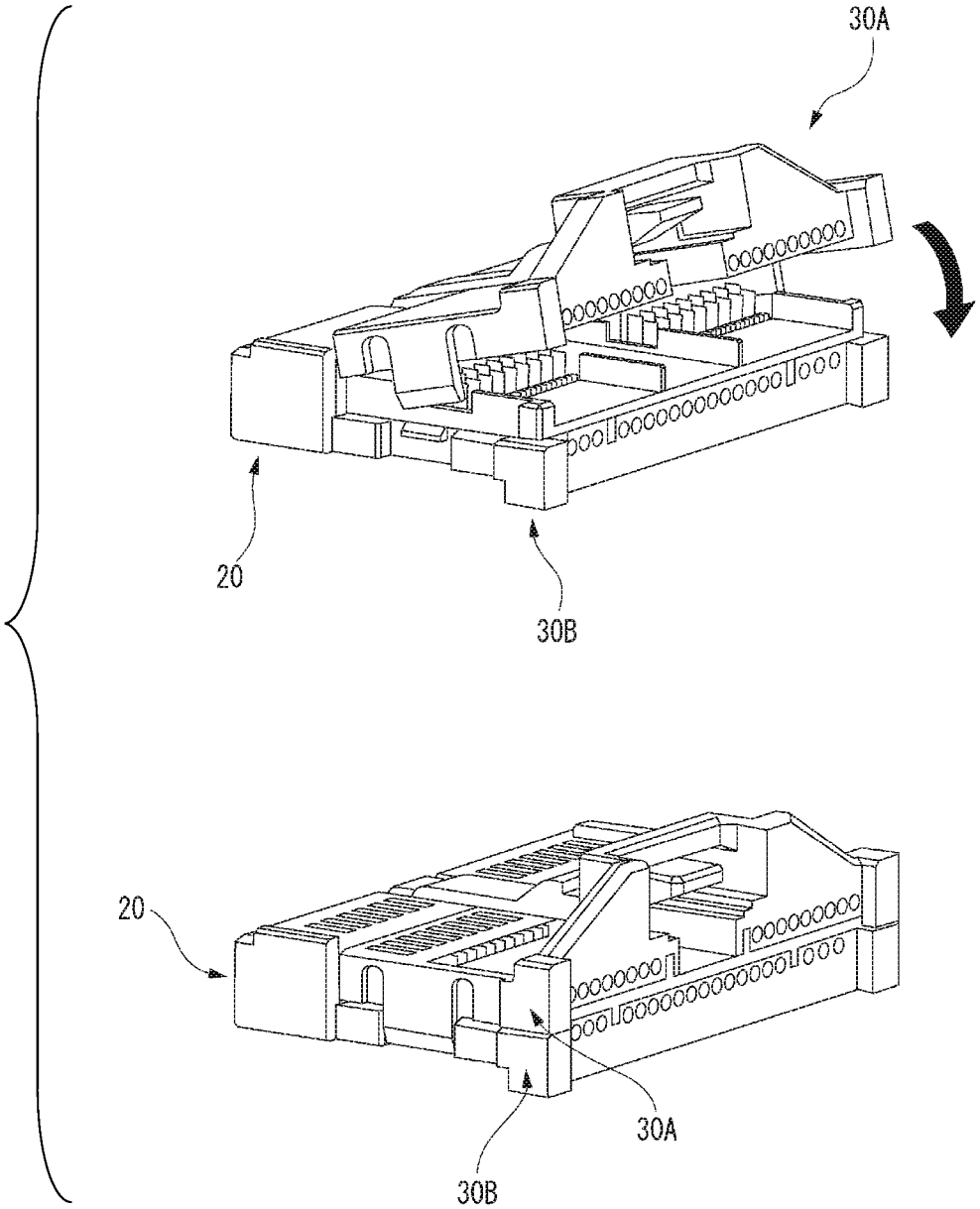
FIG. 28 is a fifth view for explaining the procedure of assembling the connector.

Next, as shown in FIG. 27, the lower cover 30B is assembled to the housing 20, and then, as shown in FIG. 28, the upper cover 30A is assembled to the housing 20. The procedure of assembling the upper cover 30A to the housing 20 and the procedure of assembling the lower cover 30B to the housing 20 are substantially the same except that the upper cover 30A and the lower cover 30B are symmetrical in the vertical direction. Therefore, only the procedure of assembling the upper cover 30A to the housing 20 will be described below.

In a state where the terminal 10 inserted into the terminal accommodating portion is in the primary locking position, first, the front end edge of the upper cover 30A (cover main body 31) is brought close to the rear end edges of the top wall portions 23 of the housing 20 and the projection portions 34 of the upper cover 30A is brought into contact with the rear end of the connecting portions 11 of the terminals 10 while maintaining the state where the rear side of the upper cover 30A is inclined upward from the front side.

Next, the upper cover 30A is moved forward with respect to the housing 20 until the tapered surface 33 of the front end edge of the upper cover 30A enters the lower sides of the tapered surfaces 25 of the rear end edges of the top wall portions 23 (until the front end edge of the upper cover 30A is engaged with the rear end edges of the top wall portions 23) while maintaining this state (the upper cover 30A is inclined and the projection portions 34 are brought into contact with the connecting portions 11 of the terminals 10). At this time, due to the pressing of the projection portions 34, the terminals 10 move from the primary locking positions to the normal insertion positions along with the forward movement of the upper cover 30A.

Then, while maintaining the state that the front end edge of the upper cover 30A is engaged with the rear end edges of the top wall portions 23, the upper cover 30A in the inclined state is pivoted in a direction in which the rear side of the upper cover 30A approaches the housing 20 with the front end side of the upper cover 30 A as a fulcrum. As a result, a plurality of the engaging portions 35 of the upper cover 30A and a plurality of the engaging portions 36 of the lower cover 30B are engaged with each other to obtain a state that the upper cover 30A and the lower cover 30B are assembled to the housing 20, as shown in FIG. 20.

When the upper cover 30A is assembled to the housing 20, the projection portions 34 of the upper cover 30A are in contact with or approach the rear end surfaces of the connecting portions 11 of the terminals 10. Therefore, the terminals 10 are retained in the housing 20. That is, in addition to the engagement of the protruding portions 14 and the lances 26 of the terminals 10, a so-called double lock state is obtained by the engagement between the connecting portions 11 of the terminals 10 and the projection portions 34.

As described above, the upper cover 30A is designed to be attached to the housing 20 in the normal state only by pivoting the upper cover 30A in the inclined state with the front end side of the upper cover 30A as the fulcrum. Even when the upper cover 30A is moved parallel to the housing 20 while being moved parallel from the upper side to the lower side and assembled to the housing 20, the front end edge of the upper cover 30A and the rear edges of the top wall portions 23 interfere with each other, so that the upper cover 30A cannot be assembled.

Figure 29:
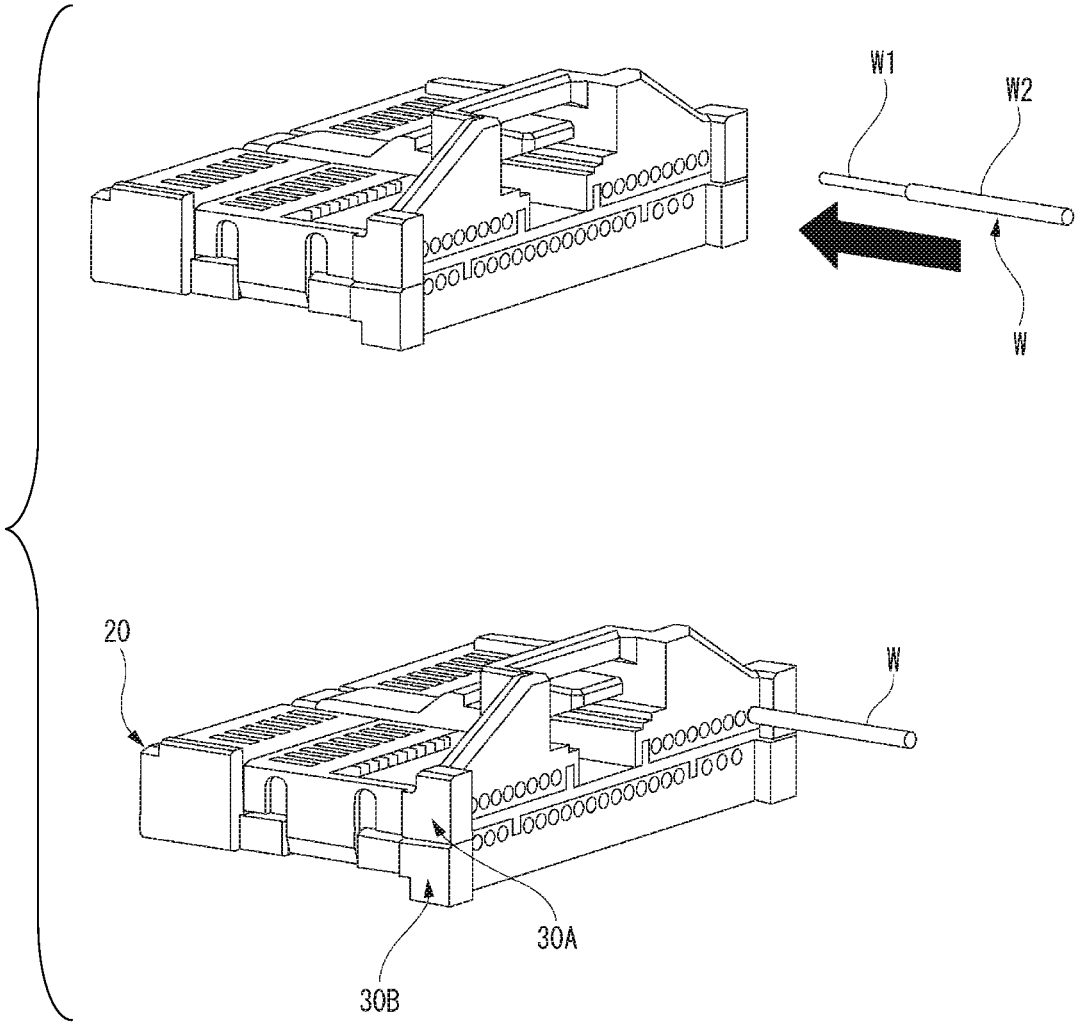
FIG. 29 is a sixth view for explaining the procedure of assembling the connector.

As described above, when the upper cover 30A and the lower cover 30B are assembled to the housing 20, the electric wires W are then connected to the terminals 10 accommodated in the housing 20. Therefore, first, as shown in FIG. 29, the electric wire W is inserted into one of a plurality of the terminal accommodating portions in which the terminal 10 is accommodated, from the rear end opening of the terminal accommodating portion. The terminal processing of removing the cover W2 of the front end portion of the electric wire W is performed in advance on the electric wire W. Therefore, the front end portion of the conductor core wire W1 of the electric wire W is exposed.

Figure 31:
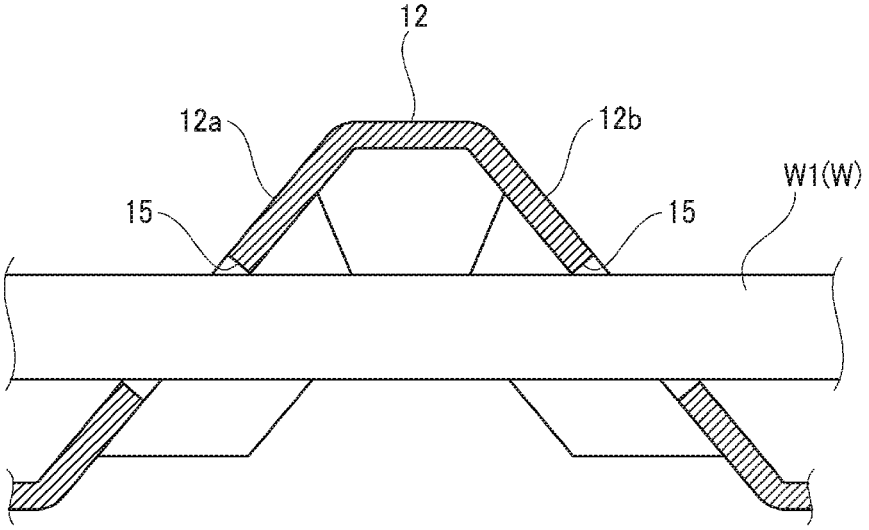
FIG. 31 is a cross-sectional view corresponding to FIG. 5 in a state that the conductor core wire of the electric wire is inserted into the first and second through holes of the conductor fixing portion of the terminal.

In this manner, by inserting the electric wire W, the conductor core wire W1 exposed at the front end portion of the electric wire W is inserted into each of the pair of through holes 15 of the conductor fixing portion 12 of the corresponding terminal 10, as shown in FIG. 31.

Figure 30:
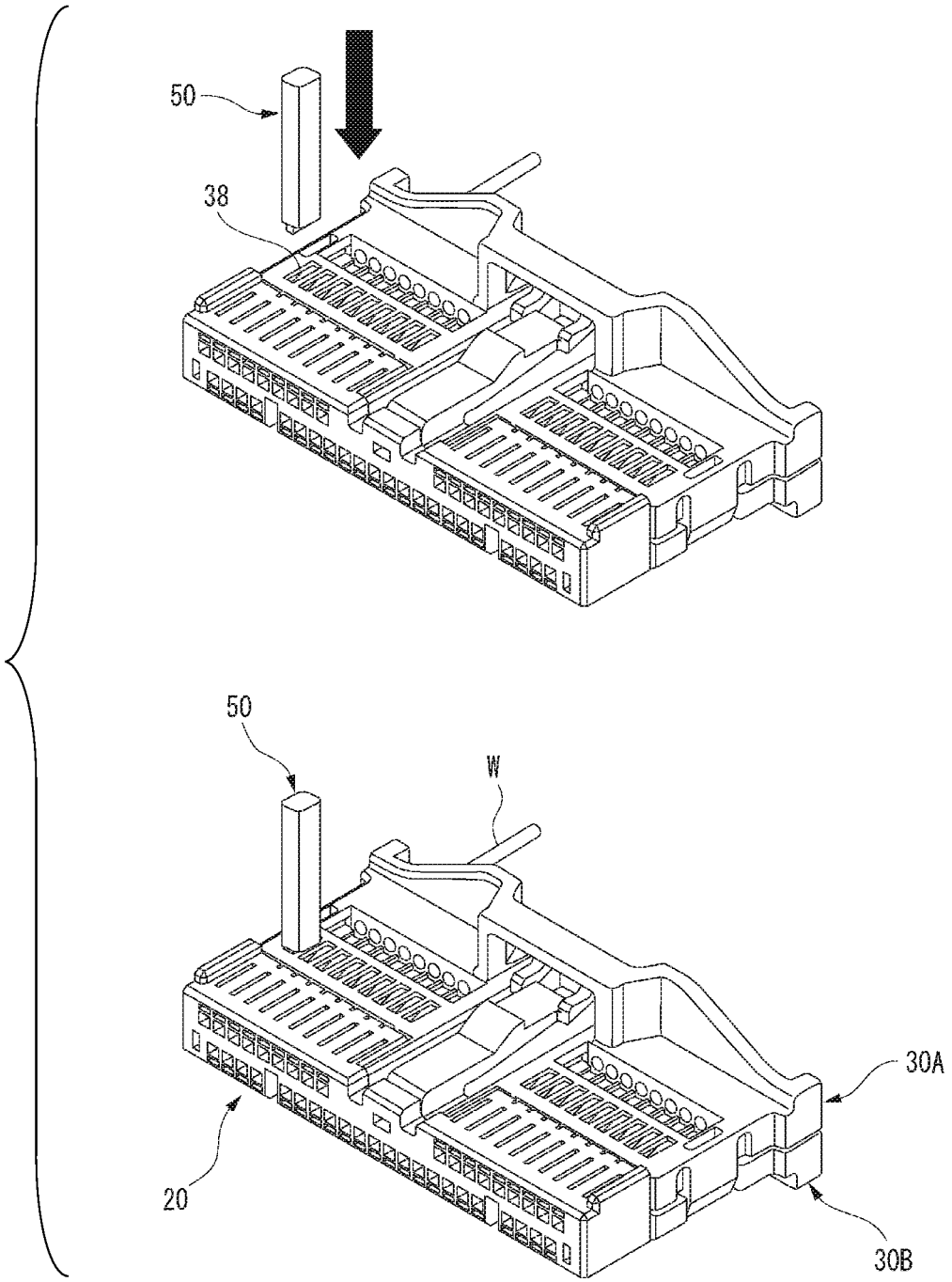
FIG. 30 is a seventh view for explaining the procedure of assembling the connector.
Figure 32:
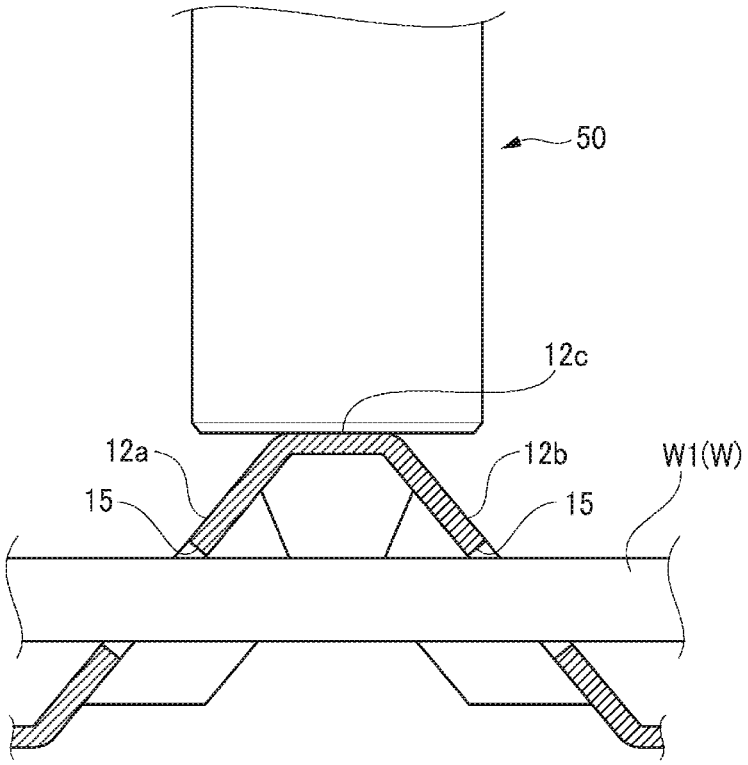
FIG. 32 is a view showing a state that a coupling portion of the conductor fixing portion is pressed downward by a jig.

Next, in this state (a state that the conductor core wire W1 of the electric wire W is inserted into the pair of through holes 15 of the conductor fixing portion 12), as shown in FIG. 30, the jig 50 is inserted downward from the upper side into the corresponding second through hole 38. As a result, as shown in FIG. 32, the lower end surface of the jig 50 is brought into contact with the coupling portion 12*c* of the conductor fixing portion 12 of the corresponding terminal 10.

Figure 33:
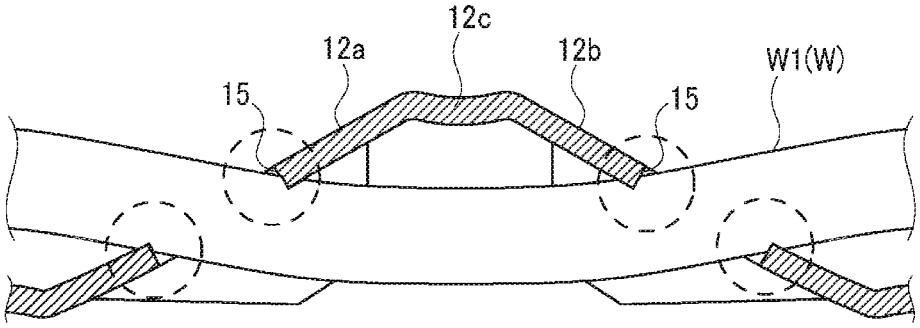
FIG. 33 is a view showing a state that end edges of a pair of through holes are bitten into the conductor core wire.

Next, in this state, the jig 50 is pressed downward. Thus, since the coupling portion 12*c* is pressed downward, the conductor fixing portion 12 is plastically deformed so as to be crushed, and as shown in FIG. 33, the respective end edges of the pair of through holes 15 are bitten into the conductor core wire W1. As a result, the conductor core wire W1 is fixed to the conductor fixing portion 12 of the terminal 10 and is electrically connected thereto.

Figure 34:
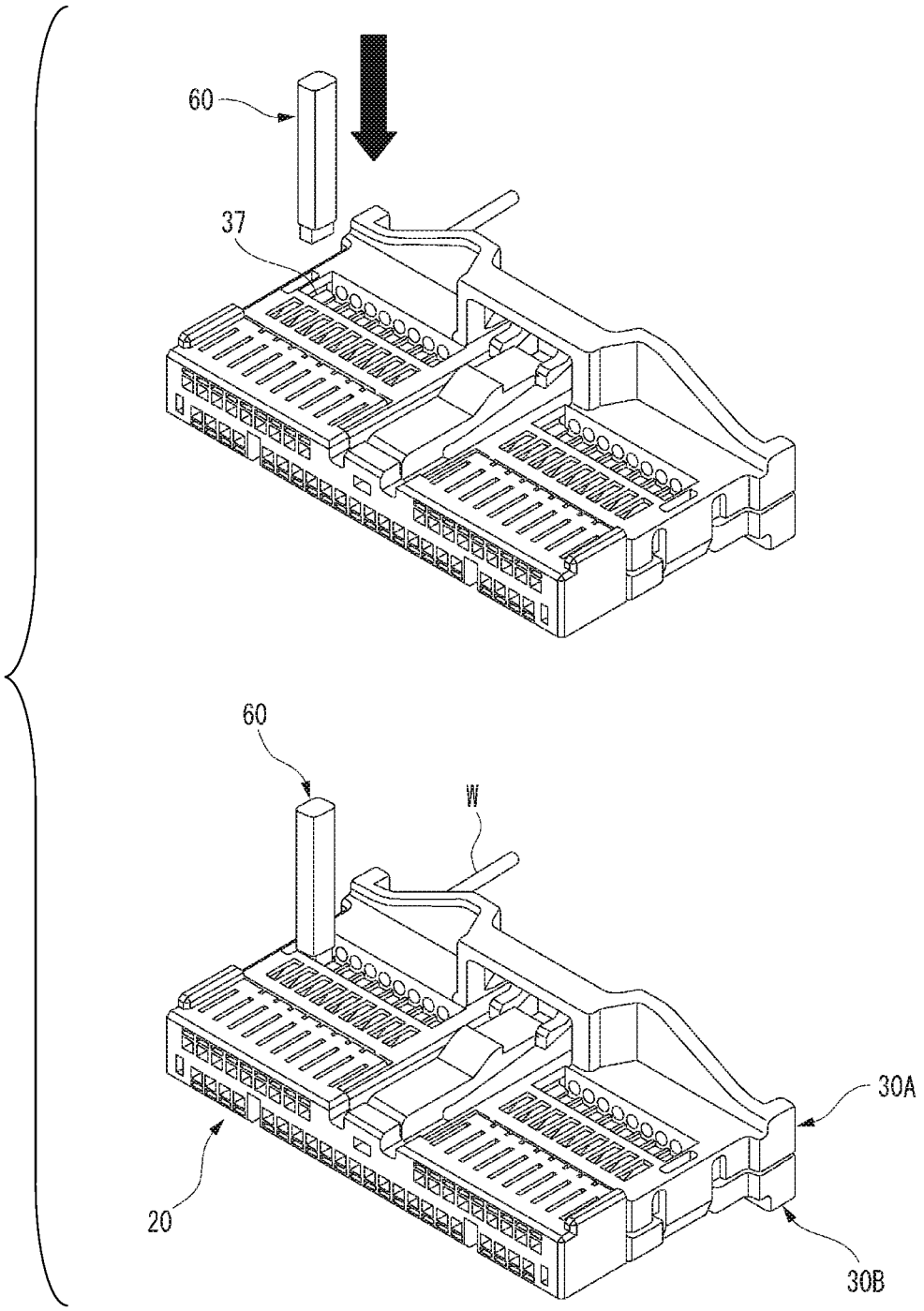
FIG. 34 is an eighth view for explaining the procedure of assembling the connector.

Next, as shown in FIG. 34, the jig 60 is inserted downward from the upper side into the corresponding position of the first through hole 37. Thus, the lower end surface of the jig 60 is brought into contact with the pair of crimping pieces 16 of the cover fixing portion 13 of the corresponding terminal 10. Next, in this state, the jig 60 is pressed downward. As a result, since the pair of crimping pieces 16 are pressed downward, the cover W2 of the electric wire W is crimped by the pair of crimping pieces 16 and fixed to the cover fixing portion 13.

Figure 35:
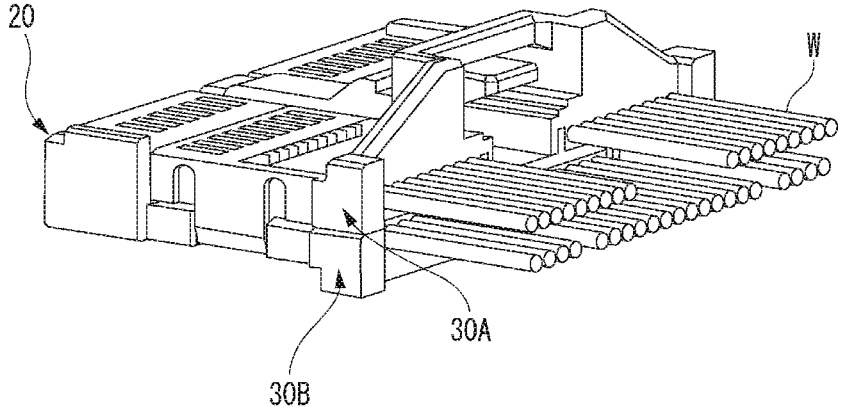
FIG. 35 is a ninth view for explaining the procedure of assembling the connector.

Accordingly, the connection of the electric wire W to the corresponding terminal 10 is completed. Thereafter, as shown in FIG. 35, the connection operation of the electric wires W shown in FIGS. 29 to 34 is repeatedly performed for all the remaining terminal accommodating portions in which the terminals 10 are accommodated.

Figure 36:
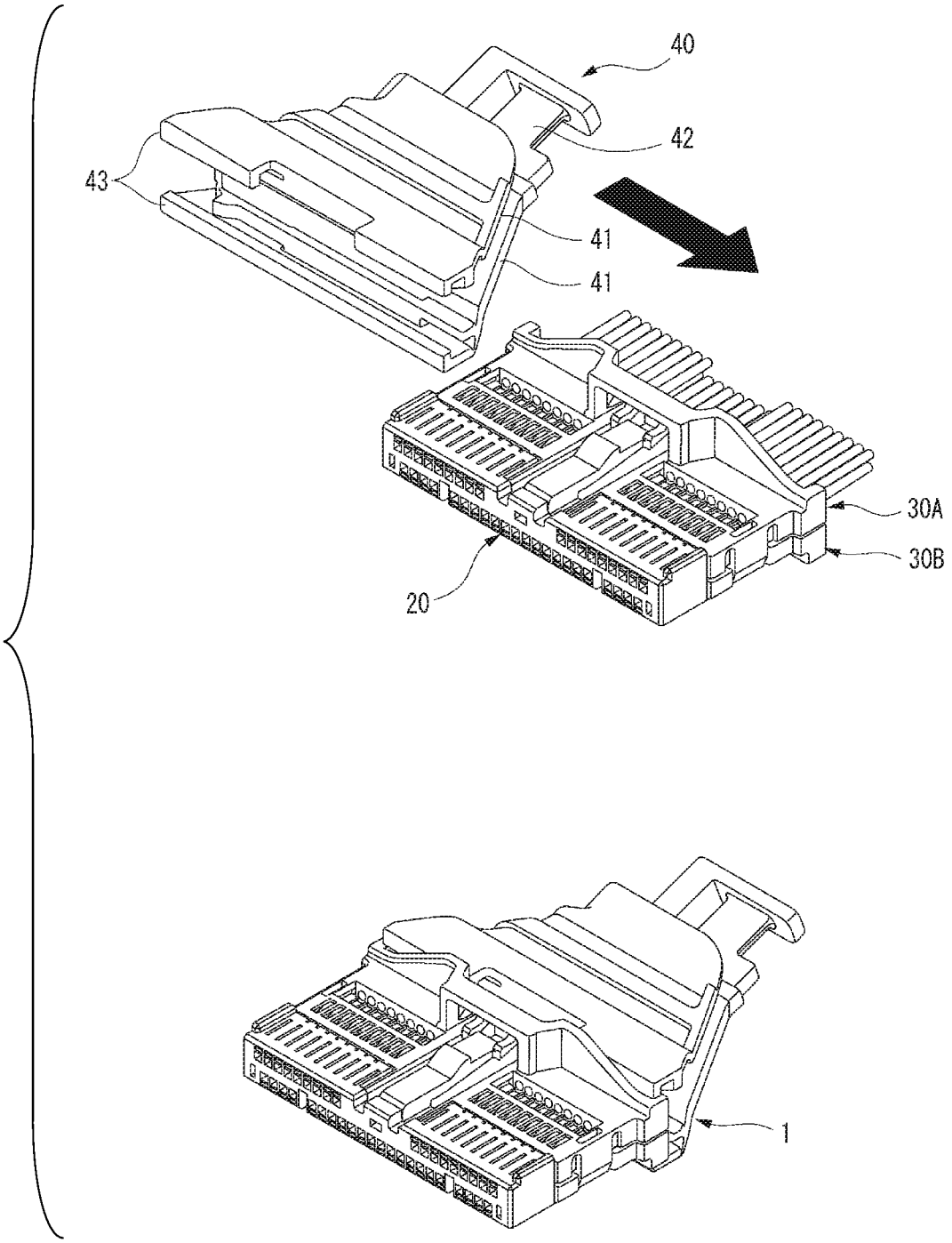
FIG. 36 is a tenth view for explaining the procedure of assembling the connector.

When the connection operation of the electric wires W is completed for all of the terminal accommodating portions in which the terminals 10 are accommodated, the connector cover 40 is attached to the housing 20 as shown in FIG. 36. Specifically, the connector cover 40 is fixed to the housing 20 such that the connector cover 40 projects rearward from the rear end surface of the housing 20 by attaching the engaging portions 43 of the pair of electric wire accommodating portions 41 to the engaging portions of the rear end portions of the upper cover 30A and the lower cover 30B assembled to the housing 20.

Finally, a plurality of the electric wires W extending rearward from the connector cover 40 are held by the electric wire holding portion 42 in a bundled state using a tie band or the like. Accordingly, the assembly of the connector 1 is completed.

According to the terminals 10 according to the embodiment of the present invention, when the electric wires W are connected to the terminals 10 after the terminals 10 are accommodated in the terminal accommodating portions of the housing 20, the conductor core wires W1 of the electric wires W can be fixed to the terminals 10 only by pressing the coupling portion 12*c* of the conductor fixing portion 12 downward to plastically deform the conductor fixing portion 12 in a state that the conductor core wire W1 is inserted into the pair of the through holes 15. Therefore, even after the terminals 10 are accommodated in the terminal accommodating portions of the housing 20, the electric wires W can be extremely easily connected to the terminals 10.

Further, since the respective end edges of the pair of through holes 15 can be bitten into the conductor core wire W1, the conductor core wire W1 of the electric wire W can be more firmly fixed to the terminal 10 as compared with the manner in which the end edge of one through hole is bitten into the conductor core wire W1.

Other Embodiments

The present invention is not limited to the above embodiments, and various modifications can be adopted within the scope of the present invention. For example, the present invention is not limited to the embodiments described above, and can be appropriately modified, improved, or the like. In addition, the material, shape, size, number, arrangement position, or the like of each component in the above-described embodiments are optional and are not limited as long as the present invention can be achieved.

In the above embodiment, the female terminal is adopted as the terminal 10, but a male terminal may be adopted as the terminal 10. In this case, the connecting portion 11 of the terminal 10 has a tab-like shape instead of the rectangular tubular shape.

Here, characteristics of the terminal 10 according to the present invention and the method of connecting the electric wire to the terminal 10 will be briefly summarized in the following [1] to [3].

[1] A terminal 10 integrally comprising:

a connecting portion 11 connected to a mating terminal;

a cover fixing portion 13 that is positioned rearward of the connecting portion 11 and fixes a cover W2 of the electric wire W including a conductor core wire W1 and the cover W2 covering the conductor core wire; and a conductor fixing portion 12 that is positioned between the connecting portion 11 and the cover fixing portion 13 and fixes the conductor core wire W1 exposed from the cover W2 of the electric wire W, wherein the terminal 10 is connected to a front end of the electric wire W, wherein the terminal 10 is made of a plate member and extends in a front-rear direction, wherein the conductor fixing portion 12 includes an inclined portion 12*a*, 12*b* extending obliquely to one side from the front-rear direction and having a through hole 15 passing through in a thickness direction, and wherein the conductor fixing portion 12 is configured to fix the conductor core wire by pressing a predetermined portion of the conductor fixing portion 12 to the other side opposite to the one side in a state that the conductor core wire W1 is inserted into the through hole 15 so that an end edge of the through hole 15 bites the conductor core wire W1.

[2] The terminal 10 according to [1], wherein the conductor fixing portion 12 integrally includes a first inclined portion 12*a*, a second inclined portion 12*b*, and a coupling portion 12*c*, wherein the first inclined portion 12*a* is connected to a rear end portion of the connecting portion 11, extends obliquely to the one side and a rear side from the rear end portion of the connecting portion 11, and includes a first through hole 15 passing through in the thickness direction, wherein the second inclined portion 12*b* is connected to a front end portion of the cover fixing portion 13, extends obliquely to the one side and a front side from the front end portion of the cover fixing portion 13, and includes a second through hole 15 passing through in the thickness direction, wherein the coupling portion 12*c* connects extended end portions of the first inclined portion 12*a* and the second inclined portion 12*b* to each other, and wherein the conductor fixing portion 12 is configured to fix the conductor core wire by pressing the coupling portion 12*c* to the other side in a state that the conductor core wire W1 of the electric wire W is inserted into the first and second through holes 15 so that the end edges of the first and second through holes 15 bite the conductor core wire W1.

[3] A method of connecting the electric wire W to the terminal 10 according to [1] or [2], the method comprising:

accommodating the terminal 10 in a terminal accommodating portion of a housing 20;

inserting the conductor core wire W1 exposed from the cover W2 of the electric wire W into the through hole 15 of the terminal 10 accommodated in the terminal accommodating portion; and pressing the predetermined portion of the conductor fixing portion 12 to the other side and biting the end edge of the through hole 15 into the conductor core wire W1 so as to fix the conductor core wire W1 to the conductor fixing portion 12, in a state that the conductor core wire W1 is inserted into the through hole 15.

DESCRIPTION OF REFERENCE NUMERALS AND SIGNS

1: Connector
10: Terminal
11: Connecting portion
12: Conductor fixing portion
12*a*: First inclined portion
12*b*: Second inclined portion
12*c*: Coupling portion
13: Cover fixing portion
15: Through hole
20: Housing
W: Electric wire
W1: conductor core wire
W2: Cover

What is claimed is:

1. An electrical terminal integrally comprising:

a connecting portion connected to a mating terminal;

a cover fixing portion that is positioned rearward of the connecting portion and fixes a cover of an electric wire including a conductor core wire and the cover covering the conductor core wire; and a conductor fixing portion that is positioned between the connecting portion and the cover fixing portion and fixes the conductor core wire exposed from the cover of the electric wire, wherein the electrical terminal is connected to a front end of the electric wire, wherein the electrical terminal is made of a conductive plate member and extends in a front-rear direction, wherein the conductor fixing portion includes an inclined portion extending obliquely to one side from the front-rear direction and having a through hole passing through in a thickness direction of the inclined portion, and wherein the conductor fixing portion is configured to fix the conductor core wire pressing by a jig a predetermined portion of the conductor fixing portion to the other side opposite to the one side in a state that the conductor core wire is inserted into the through hole so that an end edge of the through hole bites the conductor core wire.

2. The electrical terminal according to claim 1, wherein the conductor fixing portion integrally includes a first inclined portion, a second inclined portion, and a coupling portion, wherein the first inclined portion is connected to a rear end portion of the connecting portion, extends obliquely to the one side and a rear side from the rear end portion of the connecting portion, and includes a first through hole passing through in the thickness direction, wherein the second inclined portion is connected to a front end portion of the cover fixing portion, extends obliquely to the one side and a front side from a front end portion of the cover fixing portion, and includes a second through hole passing through in the thickness direction, wherein the coupling portion connects extended end portions of the first inclined portion and the second inclined portion to each other, and wherein the conductor fixing portion is configured to fix the conductor core wire pressing by the jig the coupling portion to the other side in a state that the conductor core wire of the electric wire is inserted into the first and second through holes so that the end edges of the first and second through holes bite the conductor core wire.

3. A method of connecting the electric wire to the electrical terminal according to claim 1, the method comprising:

accommodating the electrical terminal in a terminal accommodating portion of a housing;

inserting the conductor core wire exposed from the cover of the electric wire into the through hole of the electrical terminal accommodated in the terminal accommodating portion; and pressing by the jig the predetermined portion of the conductor fixing portion to the other side in a state that the conductor core wire is inserted into the through hole and making the end edge of the through hole to bite the conductor core wire so as to fix the conductor core wire to the conductor fixing portion.

* * * * *